US010694866B2

(12) United States Patent
Gallina

(10) Patent No.: US 10,694,866 B2
(45) Date of Patent: Jun. 30, 2020

(54) CRIBS

(71) Applicant: Artsana S.p.A., Grandate (IT)

(72) Inventor: Erica Gallina, Anzio (IT)

(73) Assignee: ARTSANA S.P.A., Grandate (CO) (IT)

( * ) Notice: Subject to any disclaimer, the term of this patent is extended or adjusted under 35 U.S.C. 154(b) by 209 days.

(21) Appl. No.: 15/878,864

(22) Filed: Jan. 24, 2018

(65) Prior Publication Data

US 2018/0206651 A1 Jul. 26, 2018

(30) Foreign Application Priority Data

Jan. 25, 2017 (IT) ..... 102017000008130

(51) Int. Cl.

| | |
|---|---|
| ***A47D 9/04*** | (2006.01) |
| ***A47D 7/02*** | (2006.01) |
| ***A47D 7/04*** | (2006.01) |
| ***A47D 9/00*** | (2006.01) |

(52) U.S. Cl.

CPC ..... *A47D 9/04* (2013.01); *A47D 7/02* (2013.01); *A47D 7/04* (2013.01); *A47D 9/00* (2013.01)

(58) Field of Classification Search

CPC ..... A47D 9/04; A47D 7/02–04; A47D 9/00
See application file for complete search history.

(56) References Cited

U.S. PATENT DOCUMENTS 3,274,676 A * 9/1966 Gallagher ..... B29C 44/22 29/428
6,113,325 A 9/2000 Craft
8,677,526 B2 * 3/2014 Li ..... A47D 9/00 5/93.1

(Continued)

FOREIGN PATENT DOCUMENTS

DE 20307464 U1 5/2004
EP 2976973 A1 1/2016

(Continued)

OTHER PUBLICATIONS

Alejandro L. Garcia, Physics of Balance and Weight Shift, pp. 1-22 (Year: 2011).*

(Continued)

*Primary Examiner* — David R Hare
*Assistant Examiner* — Adam C Ortiz
(74) *Attorney, Agent, or Firm* — MH2 Technology Law Group LLP

(57) ABSTRACT

A crib may include: an upper frame; an enclosure made of flexible material, connected to the upper frame and having an openable side; a lower frame connected to the upper frame and configured to support a mattress; and two guides. The upper frame may include a first portion, connected to the lower frame and having two first ends, and a second portion, movable relative to the first portion and having two second ends. The upper frame may be switched between a closed configuration, in which the second ends are locked with respect to the first ends, and an open configuration, in which the second portion is spaced from the first ends. The guides may extend from the first portion of the upper frame toward the lower frame. The second ends may be configured to slide along a respective guide to move from the closed to the open configuration.

20 Claims, 8 Drawing Sheets

(56) References Cited

U.S. PATENT DOCUMENTS

| | | | | |
|---|---|---|---|---|
| 8,745,780 | B2 * | 6/2014 | Su | A47D 7/04 312/301 |
| 2002/0152550 | A1 | 10/2002 | Tharalson et al. | |
| 2005/0034232 | A1 | 2/2005 | Martin | |
| 2010/0115695 | A1 | 5/2010 | White et al. | |
| 2011/0258776 | A1 * | 10/2011 | Schwartz | A47D 7/02 5/100 |
| 2014/0101847 | A1 | 4/2014 | Von Rohrscheidt et al. | |
| 2014/0208503 | A1 * | 7/2014 | Horst, Jr. | A47D 7/01 5/93.1 |

FOREIGN PATENT DOCUMENTS

| | | | |
|---|---|---|---|
| GB | 2423243 | A | 8/2006 |
| WO | 2016/012955 | A1 | 1/2016 |

OTHER PUBLICATIONS

Italian Search Report dated Oct. 23, 2017, in Italian Application No. 201700008130, 7 pages.
Italian Search Report dated Oct. 16, 2017, in Italian Application No. 201700008138, 7 pages.
Non-final Office Action, U.S. Appl. No. 15/878,971, dated Nov. 7, 2019.

* cited by examiner

CRIBS

CROSS-REFERENCE TO RELATED APPLICATION(S)

This application claims priority under 35 U.S.C. § 119 from European Patent Application No. 102017000008130, filed on Jan. 25, 2017, in the Italian Patent and Trademark Office ("IPTO"), the entire contents of which are incorporated herein by reference.

FIELD OF THE INVENTION

The present invention relates to a baby crib, and particularly a crib to be placed adjacent to the bed of the baby's parents.

DISCUSSION OF THE RELATED ART

EP 2,976,973 B1 discloses a crib in which a side wall of the enclosure that accommodates the baby can be opened to access the crib from one side, thereby allowing the parents to care for the baby's needs directly from their bed. In the above described crib, the side walls are supported by parts of tubular elements of a frame. A movable side of the frame, corresponding to the wall to be opened may be separated from the other sides of the frame, such that the corresponding wall may be pivoted out of the crib.

PRIOR ART PROBLEM

In the crib of EP 2,976,973 B1, great care and effort must be taken to open the movable wall. The movable side must be first separated from the remaining sides of the frame and then secured to special supports.

As long as the movable side is not secured to its supports, it is only connected to the crib via the openable wall, which is generally made of a textile material, and, therefore, the movable side has a great freedom of movement and must be handled with care to avoid hazards for the baby.

Furthermore, the movable side must be separated from the remaining parts of the frame by simultaneously acting on its ends with both hands, whereby it cannot be opened by a parent with one hand busy, e.g. holding a baby bottle.

SUMMARY OF THE INVENTION

The object of the present invention is to provide the collapse of one side of a crib in an easy and safe way, thereby obviating the problems of the prior art, and particularly avoiding mutual disconnection and reconnection of rigid portions of the frame.

Another object of the invention is to allow one side of the crib to be opened while avoiding the risk that rigid parts of the frame may move freely.

A further object of the invention is to allow the openable wall of the crib to be opened and closed using one hand.

These and other objects are fulfilled by a crib as defined in any of the accompanying claims.

Advantageously, the crib of the invention is equipped with slide guides for a movable portion of the upper frame, such that the side corresponding to such movable portion can be opened by sliding the movable portion therebetween without disconnecting the latter from the guides.

Preferably, a single one-hand operable actuator allows the movable portion to be released from the other parts of the upper frame with which it is connected in the first position, and to slide along the guides.

Preferably, the wall is opened more easily due to the action of an elastically loaded roller, and as a result the movable portion is automatically moved to its proper position, as soon as it has been released from the other parts of the upper frame.

BRIEF DESCRIPTION OF THE DRAWINGS

The characteristics and advantages of the present invention will result from the following detailed description of a possible practical embodiment, illustrated as a non-limiting example in the set of drawings, in which.

Figure 1:
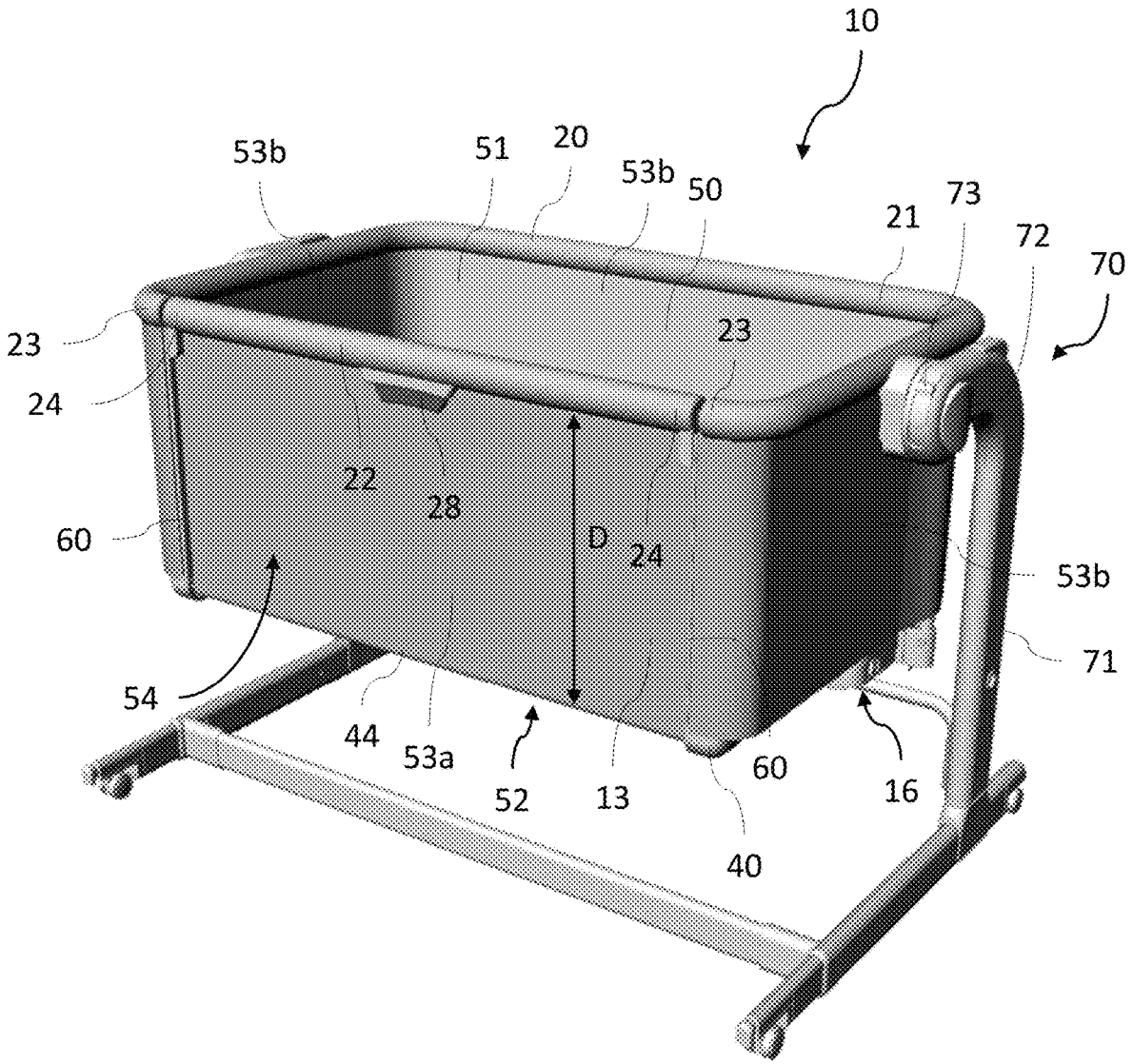
FIG. 1 shows a perspective view of a crib of the invention in an operating configuration.

The crib as shown in the accompanying figures shall be deemed to be schematically illustrated, not necessarily drawn to scale, and not necessarily representing the actual proportions of its parts.

DETAILED DESCRIPTION

Even when this is not expressly stated, the individual features as described with reference to the particular embodiments shall be intended as auxiliary to and/or interchangeable with other features described with reference to other exemplary embodiments.

The figures show a crib according to one embodiment of the invention, generally designated by numeral 10. The crib 10 comprises an upper frame 20, which defines an upper edge of the crib 10, and a lower frame 40 connected to the upper frame 20 and spaced apart therefrom.

An enclosure 50 defines an interior compartment 51 for accommodating a baby. The enclosure 50 is connected to the upper frame 20 and supported thereby. The enclosure 50 is made of a flexible material, preferably of textile nature, which provides improved comfort for the baby and can be folded on itself when the crib 10 is stored. The enclosure 50 has an opening for introducing a baby into the interior compartment 51 of the crib 10. The opening is particularly delimited by the upper edge of the crib 10.

In greater detail, the enclosure 50 comprises a bottom wall 52 which is adapted to house a mattress 11. The lower frame 40 is placed below the bottom wall 52 of the enclosure 50 and is configured to support the mattress 11. It shall be noted that the enclosure 50 comprises an openable side 54, which is configured to be placed adjacent to a bed. Preferably, the crib 10 comprises a retractable sheet 13, which is connected to the upper frame 20 to open and/or close the openable side 54.

More in detail, the enclosure 50 comprises fixed side walls 53*b* and a movable side wall 53*a*. These side walls 53*a*, 53*b* extend between the bottom wall 52 and the upper frame 20. The side walls 53*a*, 53*b* of the enclosure 50 safely keep the baby in the internal compartment 51, and prevent him from falling. The movable side wall 53*a* is placed at the openable side 54 of the enclosure 50. Therefore, the openable side 54 of the enclosure 50 may be occupied by the movable wall 53*a* to prevent the baby from coming out of the openable side 54. When the movable side wall 53*a* does not engage the openable side 54, the passage through the openable side 54 is clear.

The upper frame 20 comprises a first portion 21 and a second portion 22. The first portion 21 has two ends 23. Furthermore, the first portion 21 is defined by one or more linearly-extending rigid elements arranged along the upper edge of the crib 10 which connect together the ends 23 of the first portion 21. The first portion 21 is connected to the lower frame 40 by means of a plurality of generally rigid posts 12.

The second portion 22 of the upper frame 20 has two ends 24, and comprises a preferably rod-shaped member which extends between the two ends 24. The second portion 22 is particularly disposed at the openable side 54 of the enclosure 50, and is movable relative to the first portion 21. The aforementioned sheet 13 is also connected to the second portion 22 of the upper frame 20.

Figure 2:
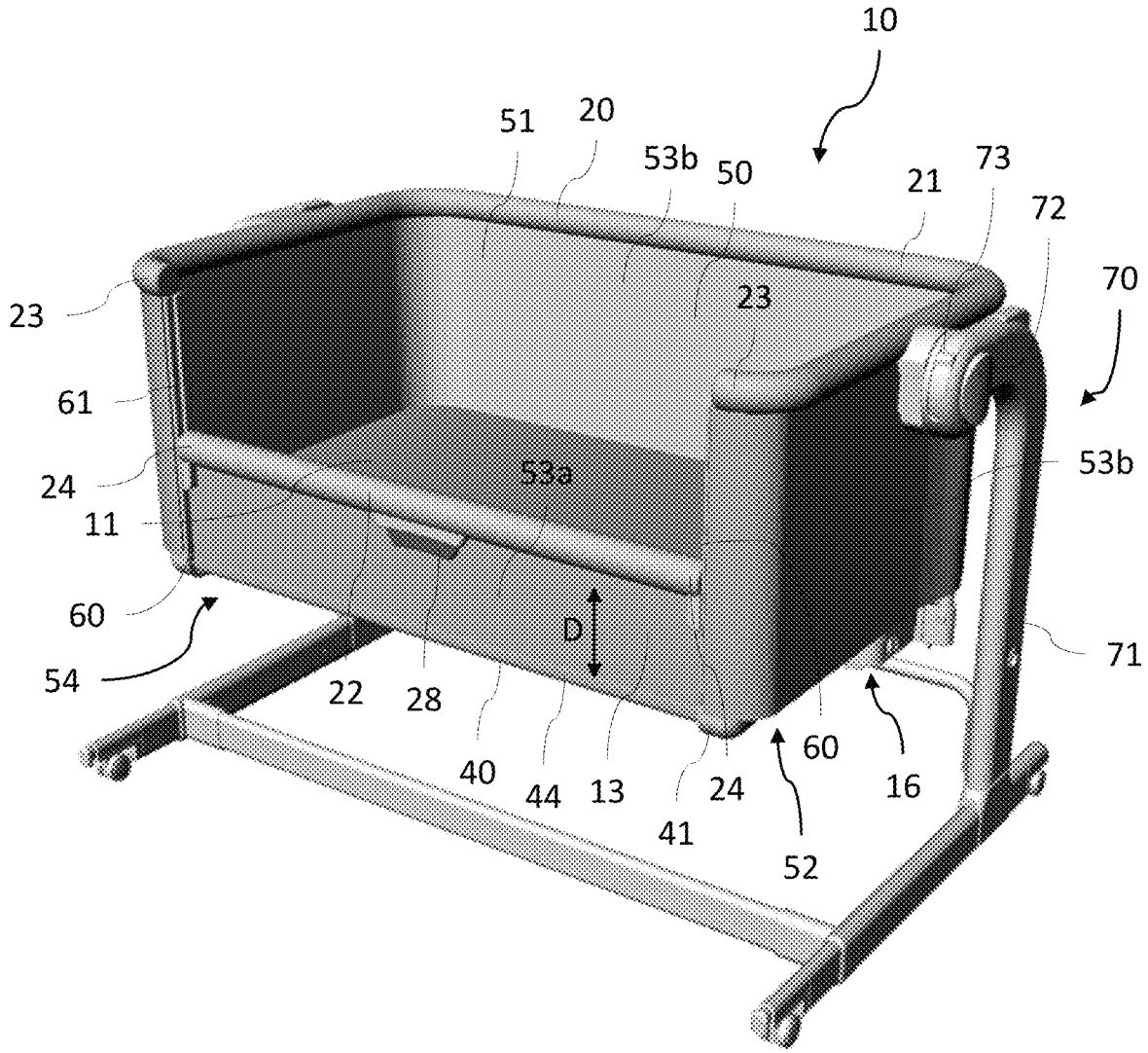
FIG. 2 shows a perspective view of the crib of FIG. 1 in another operating configuration.
Figure 3:
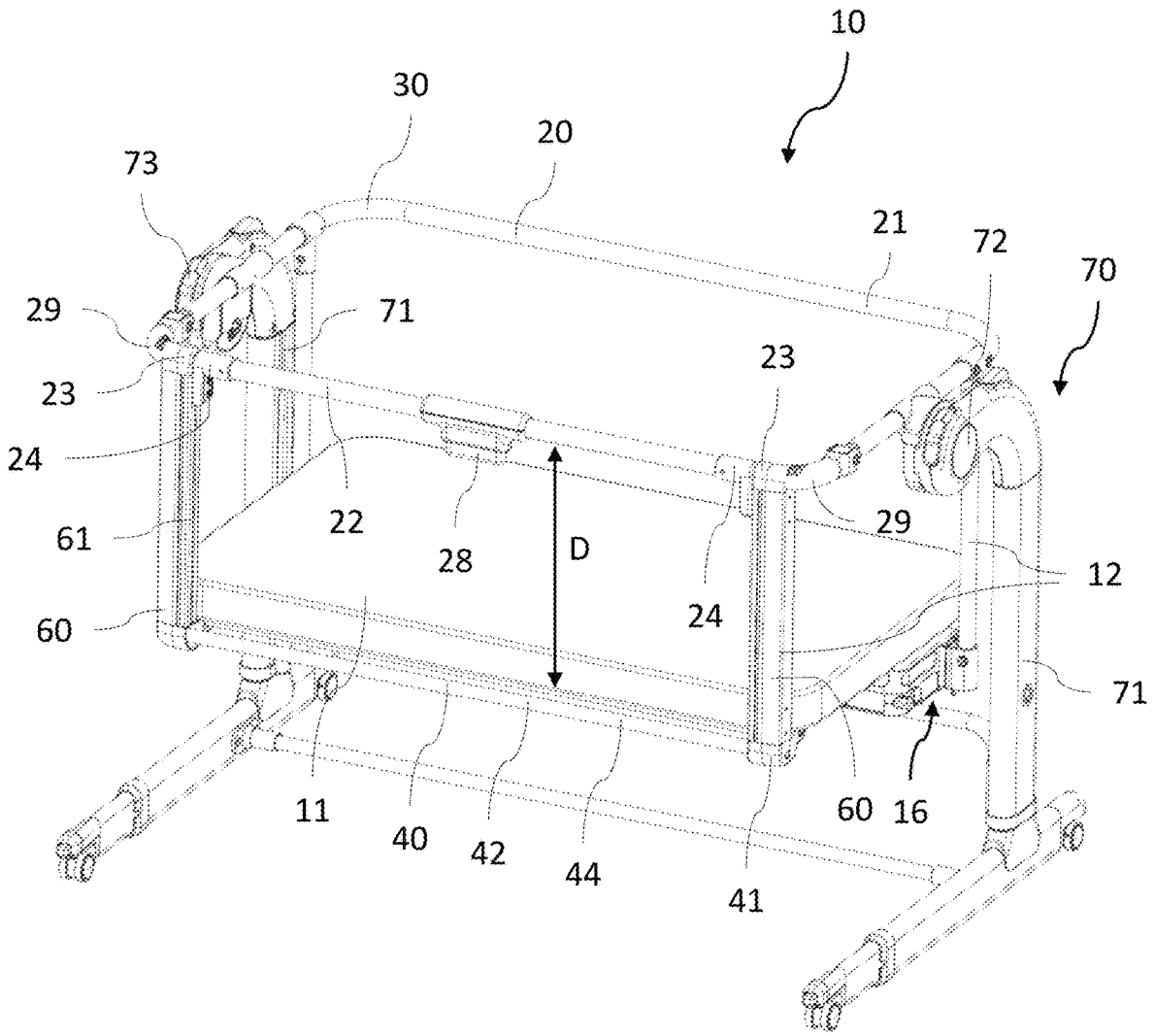
FIG. 3 shows a perspective view of the crib of FIG. 1 in the configuration of FIG. 1 without a textile enclosure.
Figure 4:
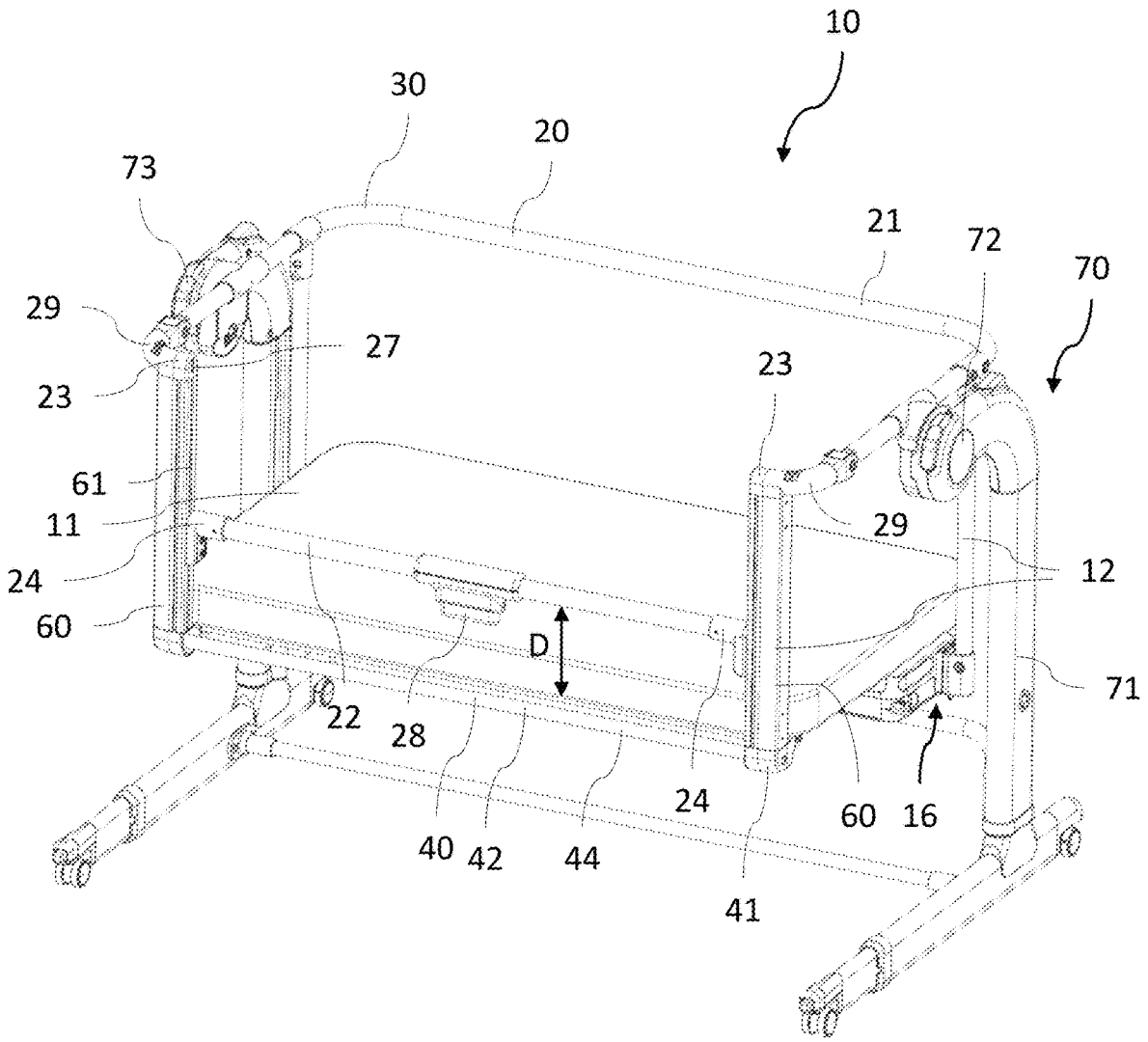
FIG. 4 shows a perspective view of the crib of FIG. 1 in the configuration of FIG. 2 without the textile enclosure.

It shall be noted that the upper frame 20 can be moved between a closed configuration, as shown in FIGS. 1 and 3, and an open configuration, as shown in FIGS. 2 and 4.

In the closed configuration, the ends 24 of the second portion 22 are locked relative to the ends 23 of the first portion 21 to close the openable side 54 of the enclosure 50. Particularly in the closed configuration the second portion 22 of the upper frame 20 is placed between the ends 23 of the first portion 21, which are preferably directly connected to the ends 24 of the first portion 21. Therefore, in the closed configuration, the second portion 22 of the upper frame 20 is placed distal from the lower frame 40. Furthermore, in the closed configuration, the sheet 13 defines the movable side wall 53*a* that closes the openable side 54 of the enclosure 50 to thereby prevent the interior compartment 51 from being accessed through the openable side 54.

In the open configuration, the second portion 22 of the upper frame 20 is spaced apart from the ends 23 of the first portion to open the openable side 54 of the enclosure 50. Particularly, in the open configuration, the second portion 22 of the upper frame 20 is placed proximal respect to the lower frame 40. As a result, in the open configuration, the sheet 13 does not prevent the interior compartment 51 of the enclosure 50 from being accessed through the openable side 54.

In one aspect of the invention, two guides 60 extend from the first portion 21 of the upper frame 20, preferably from the ends 23, toward the lower frame 40. Preferably, the guides 60 extend down to the lower frame 40. It shall be noted that the guides 60 may be each defined by a respective post 12 adjacent to the openable side 54 of the enclosure 50.

The ends 24 of the second portion 22 are able to slide along the guides 60 to move from the closed configuration to the open configuration and from the open configuration to the closed configuration. In the closed configuration the sheet 13 is disposed between the guides 60.

Figure 7:
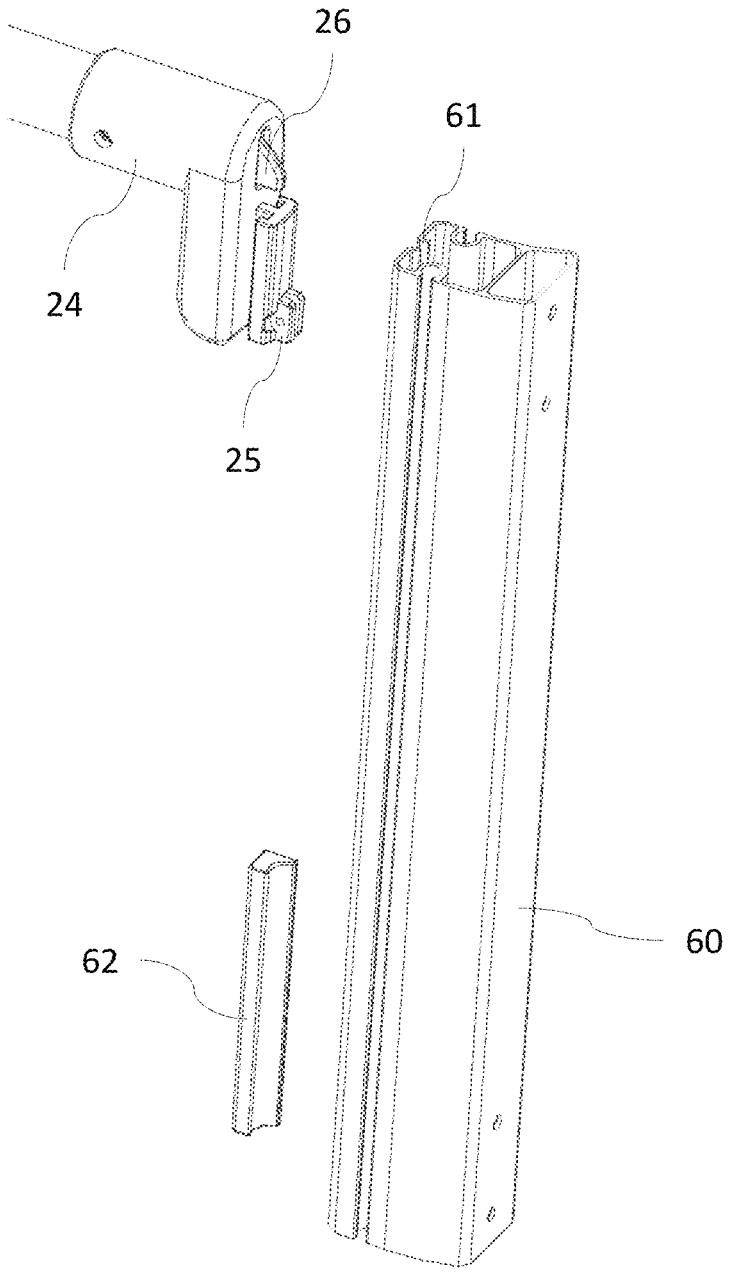
FIG. 7 shows an exploded view of a detail of the crib of FIG. 1.
Figure 8:
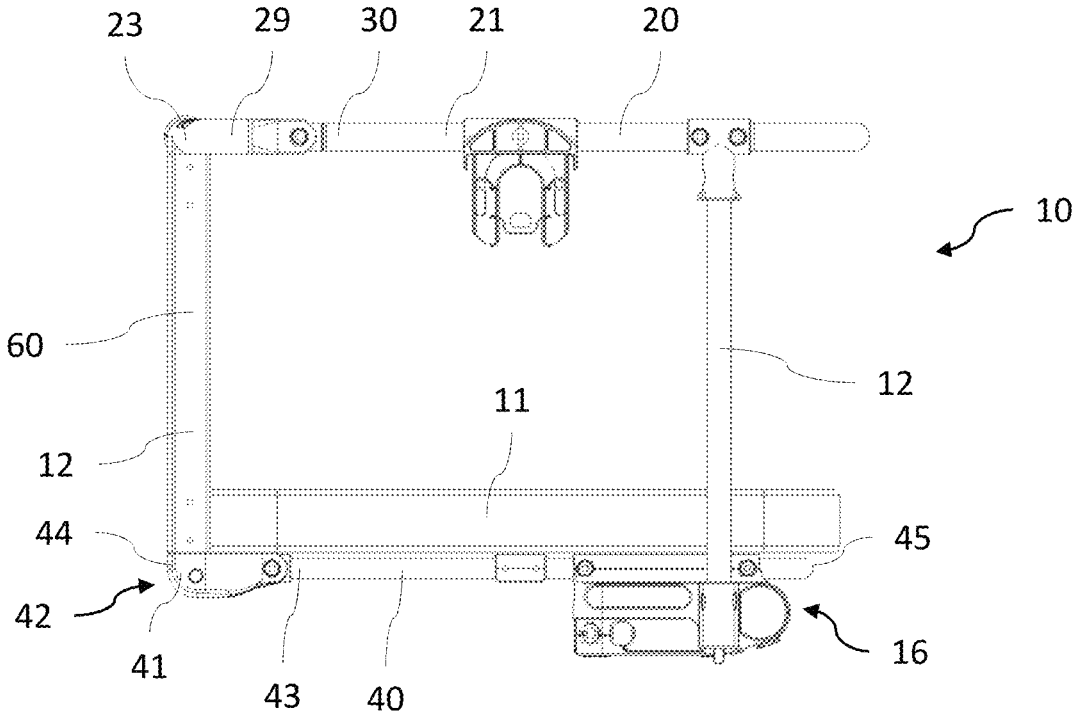
FIG. 8 shows a side view of one part of the crib of FIG. 1.

Each guide 60 has a groove 61. As shown in FIG. 7, each end 24 of the second portion 21 of the upper frame 20 comprises a slider 25 sliding inside the groove 61 of a respective guide 60. Therefore the second portion 22 of the upper frame 20 is always connected to the guides 60.

Preferably each guide 60 also comprises stop members 62, as shown in FIG. 7, which are configured to support the second portion 22 of the upper frame 20 in the open configuration, i.e. to receive the slider 25 in abutting way and prevent it from sliding toward the lower frame 40 into the open configuration. The stop members 62 are arranged, for example, inside the groove 61.

In one embodiment, the second portion 22 of the upper frame 20 comprises retractable first lock elements 26 which project out of the ends 24 of the second portion 22, and are also shown in FIG. 7. These first lock elements 26 are configured to be reversibly coupled with the ends 23 of the first portion 21 in the closed configuration, and engage in special seats 27 of the first portion 21, as shown in FIG. 4.

Preferably, the second portion 22 of the upper frame 20 comprises an actuation member 28, which is operably connected to the first lock elements 26, for instance via cables (not shown) extending in the second portion 22 of the upper frame 20. The actuation member 28 is adapted to be operated to retract the first lock elements 26 and unlock the ends 24 of the second portion 22 with respect to the ends 23 of the first portion 21. The actuation member 28 is configured to simultaneously retract the first lock elements 26 associated with both ends 24 of the second portion 22 of the upper frame 20. Preferably, the actuation member 28 is disposed in the middle of the second portion 22 of the upper frame 20. Advantageously, the actuation member 28 is adapted to be operable by one hand.

In order to move the upper frame 20 from the closed configuration to the open configuration, the user operates the actuation member 28 and slides the second portion 22 between the guides 60 toward the lower frame 40 to the stop members 62. In order to move the upper frame 20 from the open configuration to the closed configuration, the user slides the second portion 22 away from the lower frame 40 to the seats 27 of the first portion 21, where the lock elements are snap-engaged.

Figure 9:
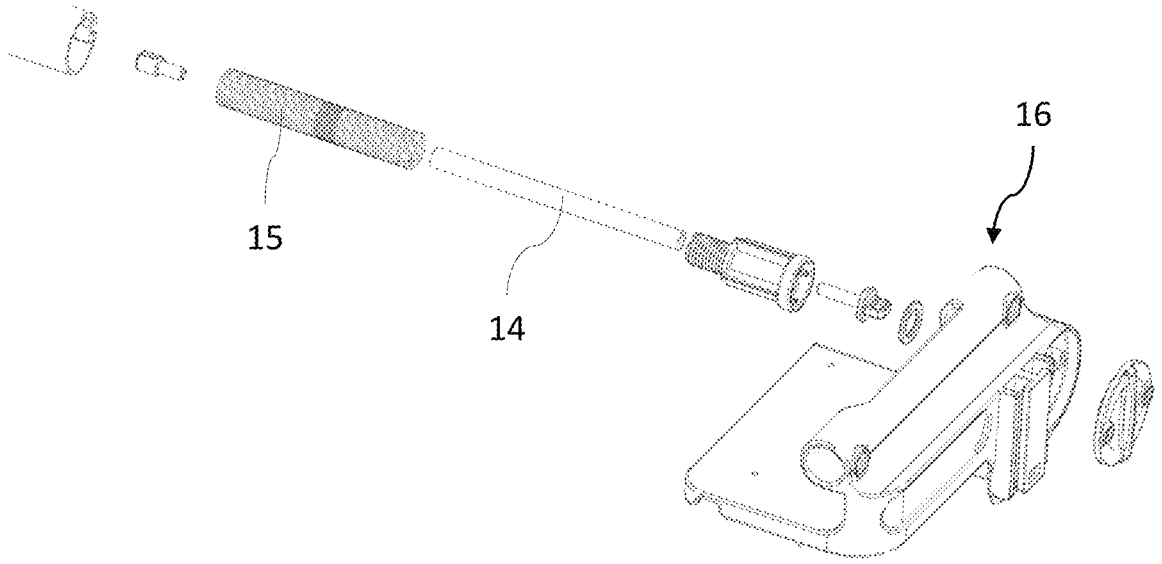
FIG. 9 shows an exploded view of a further detail of the crib of FIG. 1.

The crib 10 comprises a roller 14 connected to the sheet 13. The sheet 13 is adapted to be wound on the roller 14. As shown in FIG. 9, the crib 10 comprises elastic members 15 connected to the roller 14 for holding the sheet 13 under tension and attracting the second portion 22 of the upper frame 20 toward the lower frame 40. This will facilitate the movement from the closed configuration to the open configuration, with the upper frame 20 being held in the open configuration by the action of the elastic members on the sheet 13. FIG. 9 also shows members 16 for connecting the roller 14 to the lower frame 40.

Figure 5:
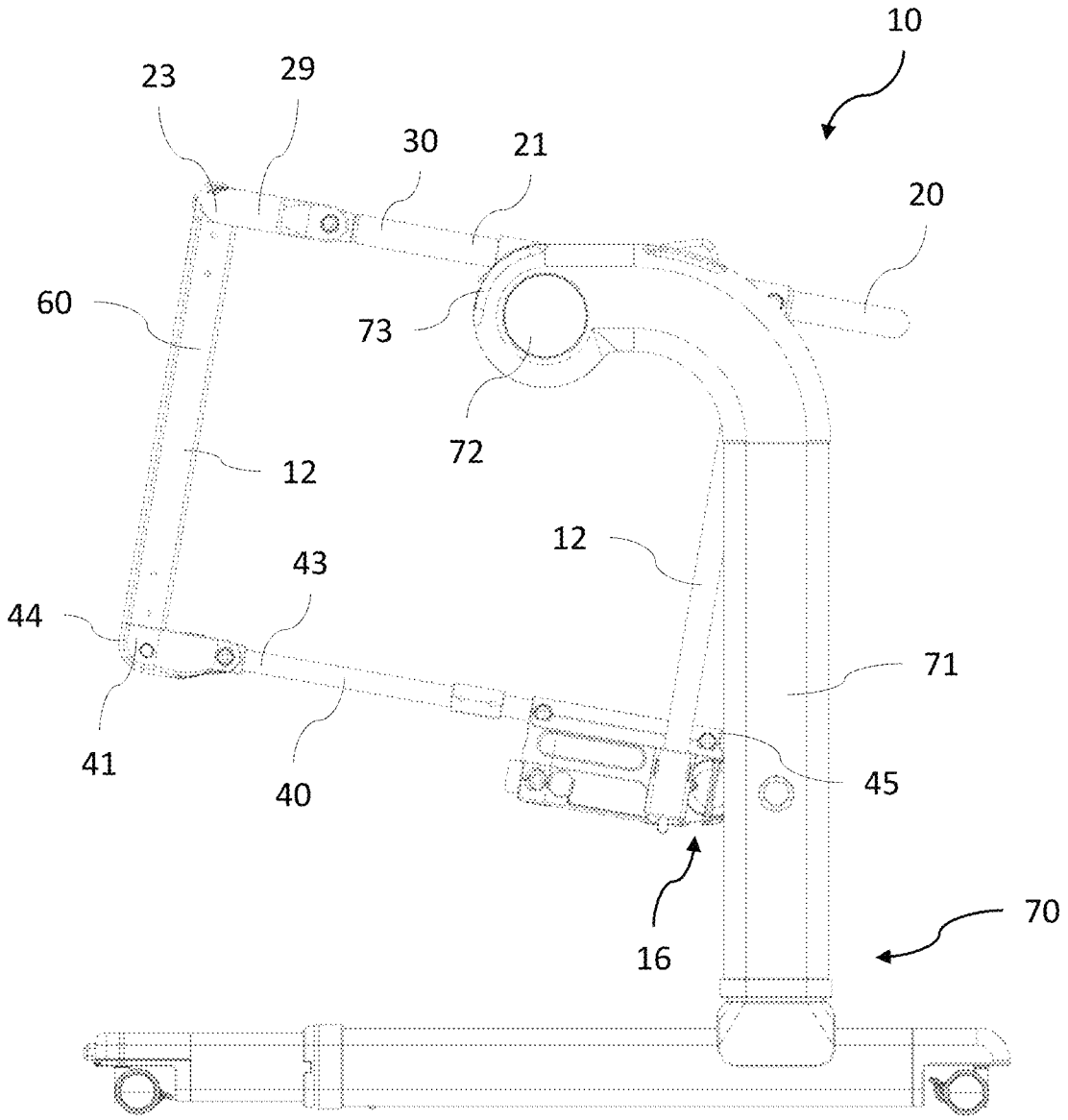
FIG. 5 shows a side view of the crib of FIG. 1 without the textile enclosure in another operating configuration.

The crib 10 comprises a support structure 70 connected to the upper frame 20 for holding the upper frame 20 and the lower frame 40 lifted up relative to a support surface. Preferably, as shown in FIG. 5, the upper frame 20 is free to rock by pivoting relative to the support structure 70 and the lower frame 40 and the enclosure 50 rock with the upper frame 20. Particularly, the support structure 70 comprises two legs 71, preferably having adjustable lengths, which are each connected to the first portion 21 of the upper frame 20 at respective pivot pins 72.

The crib 10 also comprises second lock elements 73 operable to prevent the pivoting motion of the upper frame 20 relative to the support structure 70 and to stabilize the upper frame 20. Namely, the pivoting motion of the upper frame 20 relative to the support structure 70 will be particularly advantageously prevented in the open configuration, when a baby is exposed to the risk of falling through the openable side 54 of the enclosure 50. Also, such pivoting motion will be advantageously prevented to avoid inadvertent rotations during the movement from the open configuration to the closed configuration or from the closed configuration to the open configuration, when a force must be applied to the second portion 22 of the upper frame 20. Therefore, due to the provision of the second lock elements 73, a crib may be formed in which a baby may be rocked or, once the second lock elements 72 are actuated, one side 54 of the enclosure 50 may be opened.

Preferably, in order to balance the weight of the crib 10 as the upper frame 20 pivots relative to the support structure 70, the roller 14 is placed below the lower frame 40 on the side opposite to the guides 60. In other words the junctions 41, where the lower frame 40 is connected to the guides 60, are placed at a first side 44 of the lower frame 40, located at the openable side 54 of the enclosure 50. Therefore, the roller 14 is placed at a second side 45 of the lower frame 40 opposite to the first side 44. Thus, when the crib is empty the upper frame 20 is free to rock relative to the support structure 70, and stops in a position of equilibrium in which the bottom wall 52 of the enclosure 50 is horizontal.

Figure 6:
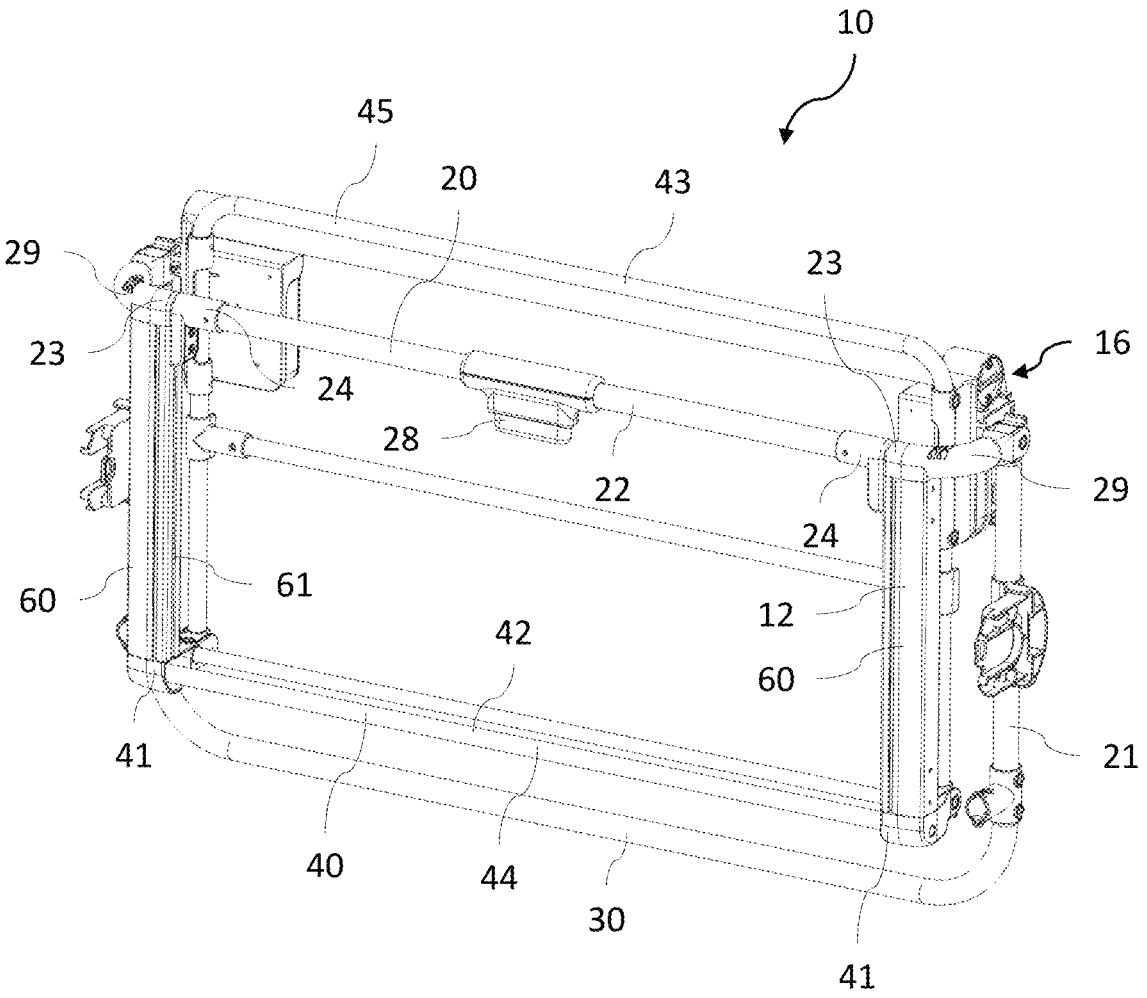
FIG. 6 shows a perspective view of the crib of FIG. 1 without the textile enclosure in a ready-for-storage configuration.

Advantageously, the upper frame 20 and the lower frame 40 may be designed for storage of the crib 10 without requiring separation of the guides 60 from the upper frame 20 and the lower frame 40, as shown in FIG. 6. Namely, the lower frame 40 comprises a connecting rod 42 and a folding portion 43. The connecting rod 42 is fastened to the guides 60 and the folding portion 43 of the lower frame 40 is rotatably restrained with the connecting rod 42 to rotate toward the guides 60 and move the lower frame 40 to a storage configuration.

Furthermore, the first portion 21 of the upper frame 20 has a pair of connection members 29 and a folding portion 30. Each connection member 29 defines a respective end 23 of the first portion 21 and is attached to a respective guide 60. Therefore, the connecting rod 42 of the lower frame 40 and the connection members 29 of the upper frame 20 are fixed together via the guides 60. The folding portion 30 of the first portion 21 of the upper frame 20 is rotatably restrained with the connection members 29 to rotate toward the guides and move the upper frame 20 to the storage configuration.

It shall be noted that, in order to store the crib 10, the support structure 70 may be required to be disconnected from the upper frame 20 and certain posts 12 may be required to be removed between the first portion 21 of the upper frame 20 and the lower frame 40.

The invention claimed is:

1. A crib comprising:

an upper frame;

an enclosure made of flexible material, which is connected to the upper frame and is configured to accommodate a baby, the enclosure having an openable side which is configured to be placed adjacent to a bed;

a lower frame connected to the upper frame and configured to support a mattress; and two guides;

wherein the upper frame comprises a first portion, connected to the lower frame and having two first ends, and a second portion, movable relative to the first portion and having two second ends, wherein the upper frame is configured to be switched between a closed configuration, in which the second ends of the second portion are locked with respect to the first ends of the first portion to close the openable side, and an open configuration, in which the second portion is spaced from the first ends of the first portion to open the openable side, wherein the two guides extend from the first portion of the upper frame toward the lower frame, wherein the second ends of the second portion are configured to slide along a respective one of the guides to move from the closed configuration to the open configuration, wherein the lower frame comprises a connecting rod, fixed to the guides, and a lower folding portion, rotatably connected to the connecting rod for rotating toward the guides so as to move the lower frame to a storage configuration of the lower frame, wherein the first portion of the upper frame comprises a pair of connection members, each of the connection members fixed to a respective one of the guides, and wherein the first portion further comprises an upper folding portion, rotatably connected to the connection members for rotating toward the guides so as to move the upper frame to a storage configuration of the upper frame.

2. The crib of claim 1, wherein the second portion of the upper frame comprises retractable first lock elements which protrude from the second ends of the second portion and which are configured to be reversibly coupled with the first ends of the first portion in the closed configuration.

3. The crib of claim 2, wherein the second portion of the upper frame further comprises an actuation member, which is operably connected to the first lock elements and which is configured to be actuated to retract the first lock elements and unlock the second ends of the second portion with respect to the first ends of the first portion of the upper frame.

4. The crib of claim 1, wherein each of the guides has a groove, and wherein each second end of the second portion of the upper frame comprises a slider which is adapted configured to slide in the groove of a respective one of the guides.

5. The crib of claim 1, further comprising:

a retractable sheet connected to the second portion of the upper frame;

wherein the retractable sheet defines, in the closed configuration, a side wall of the enclosure to close the openable side.

6. The crib of claim 5, further comprising:

a roller connected to the retractable sheet;

wherein the retractable sheet is configured to be wound on the roller.

7. The crib of claim 6, further comprising:

elastic members connected to the roller for holding the retractable sheet under tension and for attracting the second portion of the upper frame toward the lower frame.

8. The crib of claim 1, further comprising:

a support structure connected to the upper frame for holding the upper frame and the lower frame lifted up relative to a support surface, the upper frame being free to rock by pivoting relative to the support structure; and second lock elements operable to prevent the pivoting motion of the upper frame relative to the support structure and to stabilize the upper frame in the open configuration.

9. The crib of claim 6, wherein the roller is placed below the lower frame on a side opposite to the guides to balance a weight of the crib as the upper frame pivots relative to the support structure.

10. The crib of claim 1, wherein the connecting rod of the lower frame and the connection members of the upper frame are fixed together via the guides.

11. The crib of claim 1, wherein each of the connection members of the first portion defines a respective one of the first ends of the first portion of the upper frame.

12. The crib of claim 1, wherein the guides are fixed to each other through the connecting rod.

13. The crib of claim 1, further comprising:

posts that connect the upper frame to the lower frame at a side of the crib opposite to the openable side;

wherein the posts are removable.

14. The crib of claim 8, wherein the support structure is disconnectable from the upper frame to store the crib.

15. A crib, comprising:

an upper frame;

an enclosure made of flexible material, which is connected to the upper frame and is configured to accommodate a baby, the enclosure having an openable side which is configured to be placed adjacent to a bed;

a lower frame connected to the upper frame and configured to support a mattress; and two guides;

wherein the upper frame comprises a first portion, connected to the lower frame and having two first ends, and a second portion, movable relative to the first portion and having two second ends, wherein the upper frame is configured to be switched between a closed configuration, in which the second ends of the second portion are locked with respect to the first ends of the first portion to close the openable side, and an open configuration, in which the second portion is spaced from the first ends of the first portion to open the openable side, wherein the two guides extend from the first portion of the upper frame toward the lower frame, wherein the second ends of the second portion are configured to slide along a respective one of the guides to move from the closed configuration to the open configuration, wherein the lower frame comprises a connecting rod, fixed to the guides, and a lower folding portion, rotatably connected to the connecting rod for rotating toward the guides so as to move the lower frame to a storage configuration of the lower frame; and wherein the first portion of the upper frame comprises a pair of connection members, each of the connection members fixed to a respective one of the guides.

16. The crib of claim 15, further comprising:

a support structure connected to the upper frame for holding the upper frame and the lower frame lifted up relative to a support surface;

wherein the upper frame is free to rock by pivoting relative to the support structure.

17. The crib of claim 16, wherein the support structure is disconnectable from the upper frame to store the crib.

18. A crib, comprising:

an upper frame;

an enclosure made of flexible material, which is connected to the upper frame and is configured to accommodate a baby, the enclosure having an openable side which is configured to be placed adjacent to a bed;

a lower frame connected to the upper frame and configured to support a mattress; and two guides;

wherein the upper frame comprises a first portion, connected to the lower frame and having two first ends, and a second portion, movable relative to the first portion and having two second ends, wherein the upper frame is configured to be switched between a closed configuration, in which the second ends of the second portion are locked with respect to the first ends of the first portion to close the openable side, and an open configuration, in which the second portion is spaced from the first ends of the first portion to open the openable side, wherein the two guides extend from the first portion of the upper frame toward the lower frame, wherein the second ends of the second portion are configured to slide along a respective one of the guides to move from the closed configuration to the open configuration, wherein the first portion of the upper frame comprises a pair of connection members, each of the connection members fixed to a respective one of the guides, and wherein the first portion further comprises an upper folding portion, rotatably connected to the connection members for rotating toward the guides so as to move the upper frame to a storage configuration of the upper frame.

19. The crib of claim 18, further comprising:

a support structure connected to the upper frame for holding the upper frame and the lower frame lifted up relative to a support surface;

wherein the upper frame is free to rock by pivoting relative to the support structure.

20. The crib of claim 19, wherein the support structure is disconnectable from the upper frame to store the crib.

* * * * *